US005951924A

United States Patent [19]

Malecha

[11] Patent Number: 5,951,924

[45] Date of Patent: Sep. 14, 1999

[54] METHOD OF FORMING HOLES IN CONCRETE

[76] Inventor: Ernie Malecha, 10675 First Timberlane Dr., Northfield, Minn. 55057

[21] Appl. No.: 08/794,273

[22] Filed: Jan. 31, 1997

[51] Int. Cl.[6] ..... E04B 1/16

[52] U.S. Cl. ..... 264/32; 264/35; 264/275; 264/278; 264/279

[58] Field of Search ..... 264/275, 31, 32, 264/35, 278, 279, 273

[56] References Cited

U.S. PATENT DOCUMENTS

| | | | |
|---|---|---|---|
| 3,715,958 | 2/1973 | Crawford et al. | 52/21 |
| 3,727,876 | 4/1973 | Keyser | 264/274 |
| 4,103,862 | 8/1978 | Moore | 249/53 B |
| 4,119,291 | 10/1978 | Polito | 249/11 |
| 4,177,229 | 12/1979 | Moore | 264/40.5 |
| 4,222,687 | 9/1980 | Williams | 408/79 |
| 4,318,880 | 3/1982 | McIntosh et al. | 264/267 |
| 4,365,780 | 12/1982 | Williams | 249/11 |
| 4,427,173 | 1/1984 | MacKay | 249/39 |
| 4,484,724 | 11/1984 | Srackangast | 249/11 |
| 4,625,976 | 12/1986 | Gilbert | 277/12 |
| 4,842,785 | 6/1989 | Daigle et al. | 264/35 |
| 4,867,411 | 9/1989 | Dorsey et al. | 249/11 |
| 4,941,643 | 7/1990 | Ditcher | 249/145 |
| 4,997,215 | 3/1991 | Fournier | 285/230 |
| 5,413,307 | 5/1995 | Tidwell | 249/11 |

*Primary Examiner*—Karen Aftergut
*Attorney, Agent, or Firm*—Kinney & Lange, P.A.

[57] ABSTRACT

A method of forming an opening in a concrete structure. The method includes providing reinforcement wire for reinforcing the concrete structure. First and second bodies are attached to the reinforcement wire at a selected location so that the first and second bodies are on opposite sides of the reinforcement wire. The concrete structure is formed over the reinforcement wire. The first and second bodies are removed from the concrete structure to expose the opening.

10 Claims, 5 Drawing Sheets

METHOD OF FORMING HOLES IN CONCRETE

BACKGROUND OF THE INVENTION

The present invention relates to a method for fabricating concrete structures, and in particular, it relates to a method of forming openings in reinforced concrete structures such as manholes.

The use of reinforcing wire in concrete structures is very desirable since the reinforcing wire enhances the strength and integrity of the concrete structure. However, reinforcing wire presents a problem if the concrete structure needs an additional opening to be formed in a wall of the concrete structure. For example, manholes need openings so that sewer pipes may be connected to the interior region of the manhole.

By the term "manhole" it is meant the concrete structure or housing that is positioned within an excavation and into which sewer pipes are connected. Although the construction of the base and the upright wall of the manhole may be the same, the openings that accept sewer pipes have to be custom-positioned depending upon the location of the manhole and the complexity of the sewer system.

Typically what is done to form such openings in a reinforced manhole is that the opening is cut in the reinforcing wire grid at a site where the opening is to be located. A plug having substantially the same thickness as the wall of the manhole is then placed into the cut opening of the reinforcing wire grid and secured thereto. After the manhole is formed, the plug is removed. This method is both time consuming and results in a product that depending on where the opening is located can result in fragility of the structure. It will be appreciated that cutting out a portion of the reinforcing wire grid prior to transporting the manhole to a location where the manhole is to be installed reduces the structural integrity of the manhole and thereby makes it more likely that the manhole will be damaged.

To enhance the structural integrity of the manhole during transportation and installation, certain types of manholes are manufactured without access openings. The access openings are then cut into the manhole when the manhole is installed or ready for installation. A drawback of this approach is that it is considerably more difficult and time consuming to cut the access openings into the manhole after the manhole is fabricated rather than manufacturing the manhole with the access opening.

SUMMARY OF THE INVENTION

The present invention includes a method of forming an opening in a wall of a concrete structure. The method includes providing a reinforcing wire grid to be used for reinforcing the wall of the concrete structure. A first form body and a second form body are attached to the reinforcing wire grid at a selected site where it is desired for the concrete structure to have the opening. The first form body is positioned on one side of the reinforcing wire grid and the second form body is positioned on an opposite side of the reinforcing wire grid so that the second form body is aligned with the first form body. The first and second form bodies are secured to each other such that the first and second form bodies frictionally engage the reinforcing wire grid therebetween.

The concrete structure is then formed. After forming the concrete structure, the first and second form bodies are removed from the concrete structure to expose the opening.

Preferably, the portion of the reinforcing wire grid that extends across the opening is not removed until the concrete structure is placed in its permanent position. Thereafter, the reinforcing wire grid extending across the opening is removed.

DETAILED DESCRIPTION OF THE PREFERRED EMBODIMENTS

Figure 1:
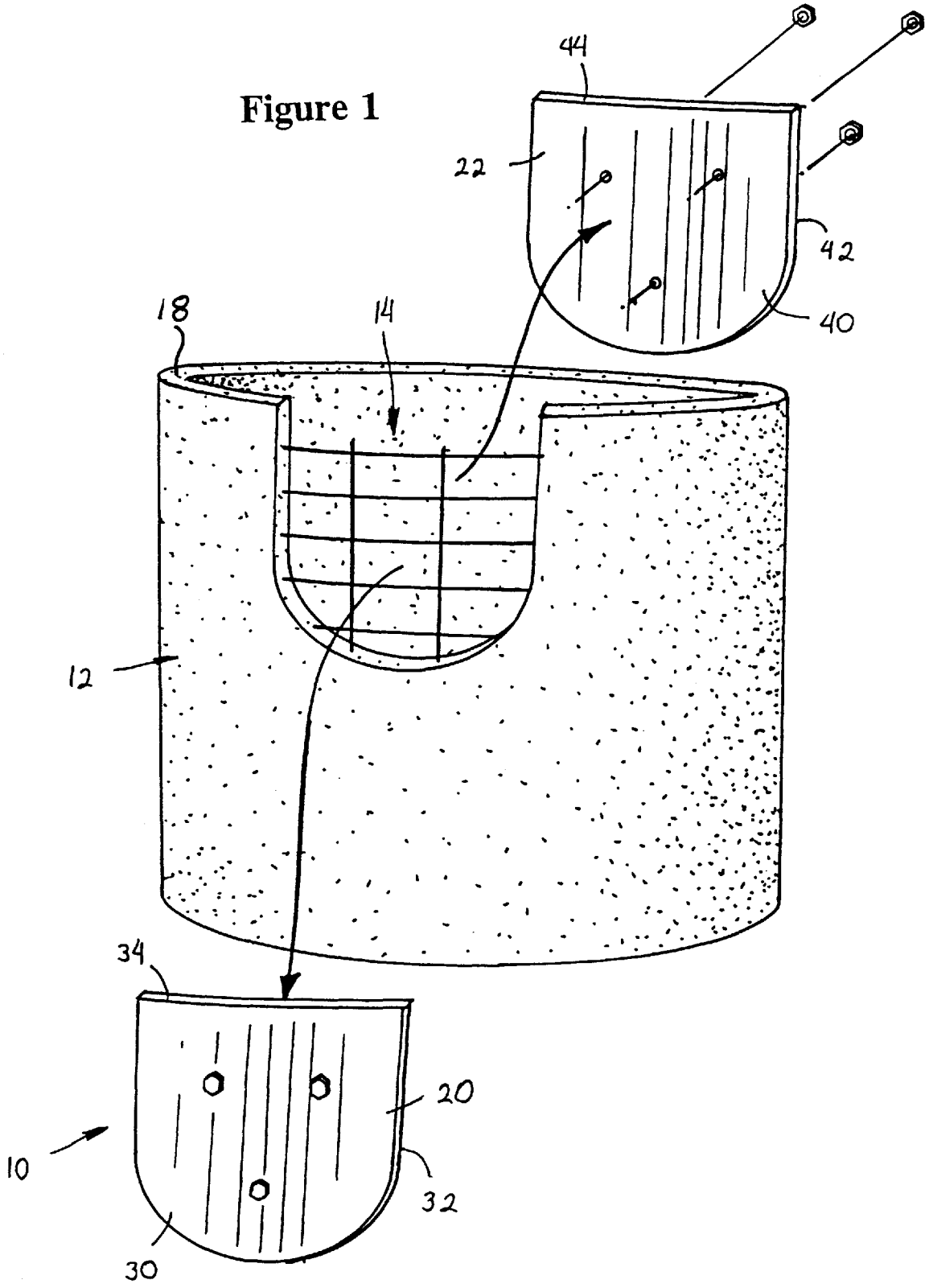
FIG. 1 is a perspective view of a concrete manhole with the hole former of the present invention being removed and showing the reinforcing wire grid extending across the opening.

A concrete hole former according to the present invention is illustrated at 10 in FIG. 1. The hole former 10 enables a concrete object 12 to be produced with an opening 14 extending through a wall 18 of the concrete object 12. A preferred use of the hole former 10 of the present invention is for manufacturing a substantially cylindrical concrete manhole having at least one opening extending through the wall of the manhole.

As described above, it is more cost effective to form openings 14 in desired locations on the concrete object 12 when the concrete object 12 is being manufactured rather than cutting the opening 14 into the concrete object 12 after the concrete object 12 has been manufactured. Using the hole former 10 of the present invention permits openings 14 to be formed into the concrete object 12 when the concrete object 12 is manufactured without cutting out a portion of a reinforcing wire grid 16 in the location of the opening 14. Because the reinforcing wire grid 16 remains intact after the concrete object 12 is manufactured, the concrete object 12 is less susceptible to damage than prior art concrete objects that are formed with openings extending therethrough.

Figure 2:
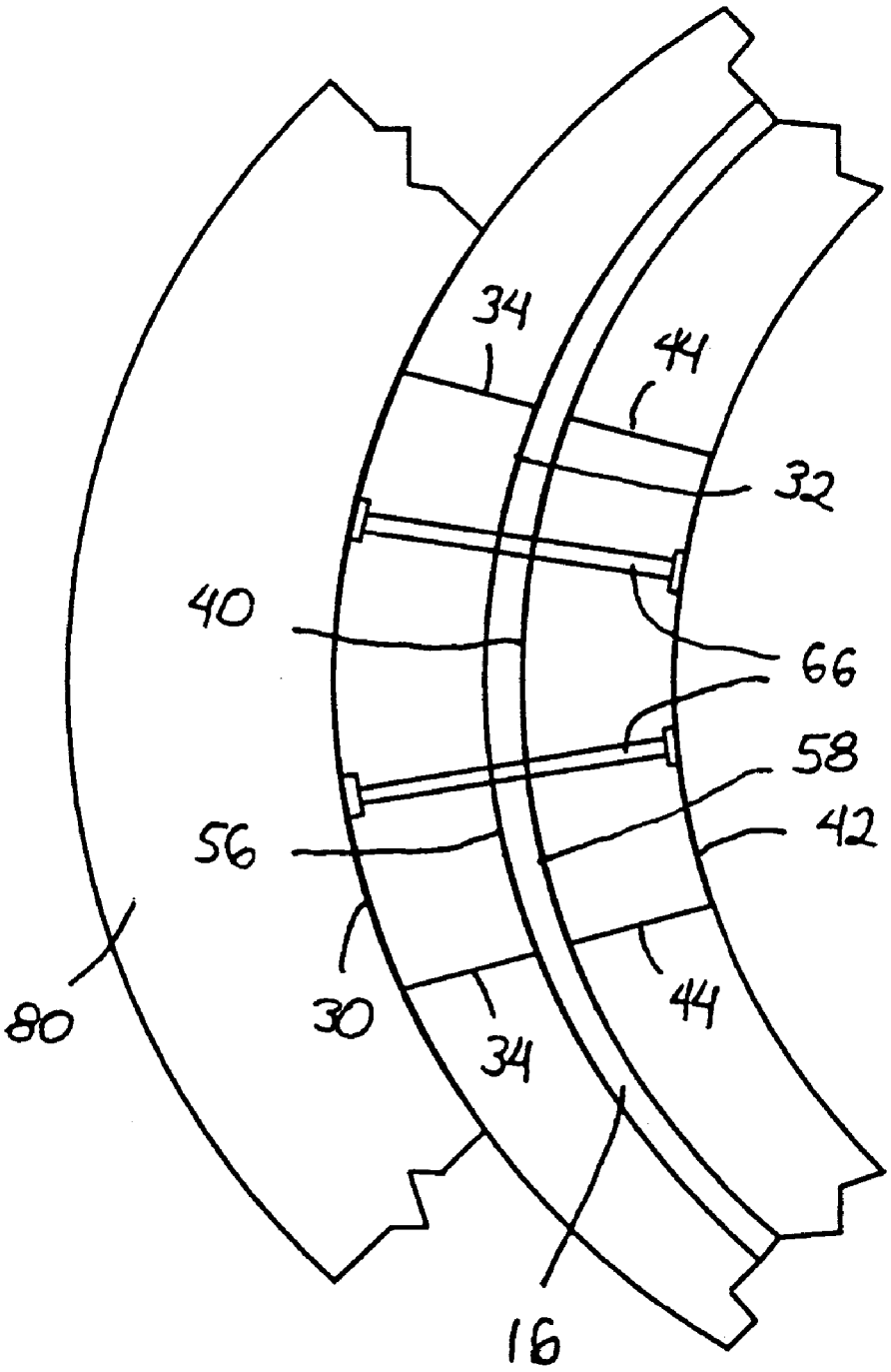
FIG. 2 is a sectional view of the embodiment illustrated in FIG. 1 before the hole former was removed from the concrete manhole.

The hole former 10 includes two main components a first form portion 20 and a second form portion 22, as illustrated in FIGS. 1 and 2. The first form portion 20 includes a first outer wall 30, a first inner wall 32, and a first edge wall 34 that extends between the first outer wall 30 and the first inner wall 32. The first outer wall 30 is preferably selected with a shape that substantially corresponds with a shape of the outer concrete form 80, as most clearly illustrated in FIG. 2. The first inner wall 32 is selected with a shape that substantially corresponds with an outer surface 56 of the reinforcing wire grid 16.

The first edge wall 34 is selected with a shape that substantially corresponds with a shape of the object that will be intersecting the concrete manhole 12 when the concrete manhole 12 is installed. For example, when the object is a substantially cylindrical sewer pipe (not shown), the first edge wall 34 preferably has a substantially cylindrical shape.

Similar to the first form portion 20, the second form portion 22 includes a second outer wall 40, a second inner wall 42, and a second edge wall 44 that extends between the second outer wall 40 and the second inner wall 42. The second outer wall 40 is selected with a shape that substantially corresponds with an inner surface 58 of the reinforcing wire grid 16. If an inner concrete form (not shown) is used in manufacturing the concrete object 12, the second inner wall 42 has a shape that substantially corresponds with a shape of the inner concrete form.

The second edge wall 44 is preferably selected with a shape that substantially corresponds with the shape of the first edge wall 34 so that the second edge wall 44 is substantially aligned with the first edge wall 34 when the first form portion 20 and the second form portion 22 are attached to the reinforcing wire grid 16.

The first form portion 20 and the second form portion 22 are preferably retained in a fixed position with respect to the reinforcing wire grid 16 using at least one bolt 66 that extends through both the first form portion 20 and the second form portion 22. A person of ordinary skill in the art will appreciate that the number of bolts 66 used for retaining the first form portion 20 with respect to the second form portion 22 is selected based on the size of the first form portion 20 and the second form portion 22. Because the hole former 10 is retained in a stationary position on the reinforcing wire grid 16 with bolts 66, the hole former 10 permits a location of the opening 14 in the concrete object 12 to be readily adjusted.

Figure 3:
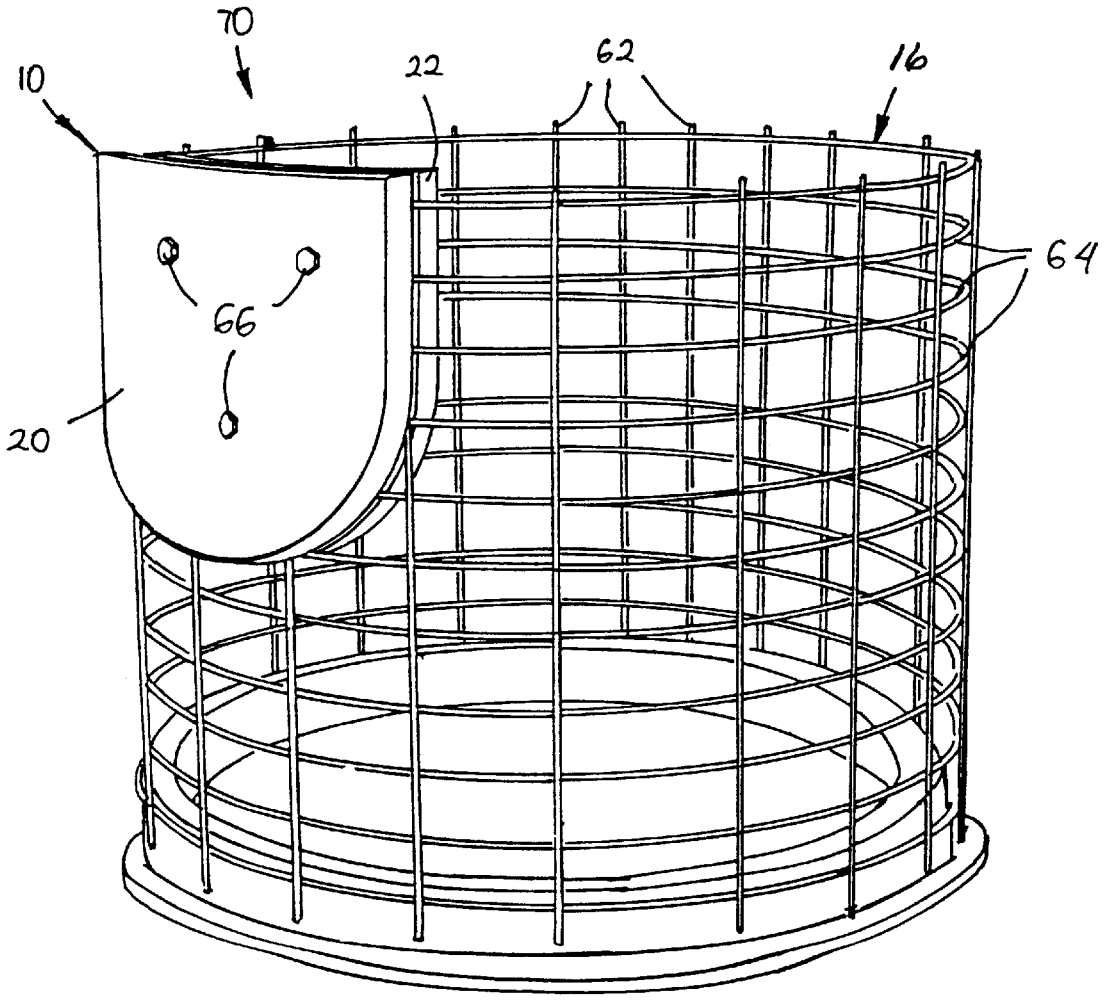
FIG. 3 is a perspective view of the hole former positioned on a reinforcing wire grid that is used as reinforcement in the concrete manhole.

The reinforcing wire grid 16 used for forming the concrete object 12 preferably includes a first plurality of wires 62 and a second plurality of wires 64, which is oriented substantially perpendicular to the first plurality of wires 62, as most clearly illustrated in FIG. 3. A person of ordinary skill in the art will appreciate that the number of wires in the first and second plurality of wires 62, 64 as well as the thickness of the wires 62, 64 is selected based on a variety of factors, such as the size of the concrete object 12 and the thickness of the walls of the concrete object 12.

In operation, once the reinforcing wire grid 16 is fabricated with a desired shape, the first form portion 20 is positioned in a desired location on the reinforcing wire grid 16 so that the first inner surface 32 is adjacent to the outer surface 56. The second form portion 22 is then positioned so that the second outer surface 40 is adjacent to the inner surface 58 and the second edge wall 44 is substantially aligned with the first edge wall 34. Next, the bolts 66 are attached to the first form portion 20 and the second form portion 22 so that first form portion 20 and the second form portion 22 frictionally engage the reinforcing wire grid 16 and are thereby retained in a stationary position on the reinforcing wire grid 16.

Figure 4:
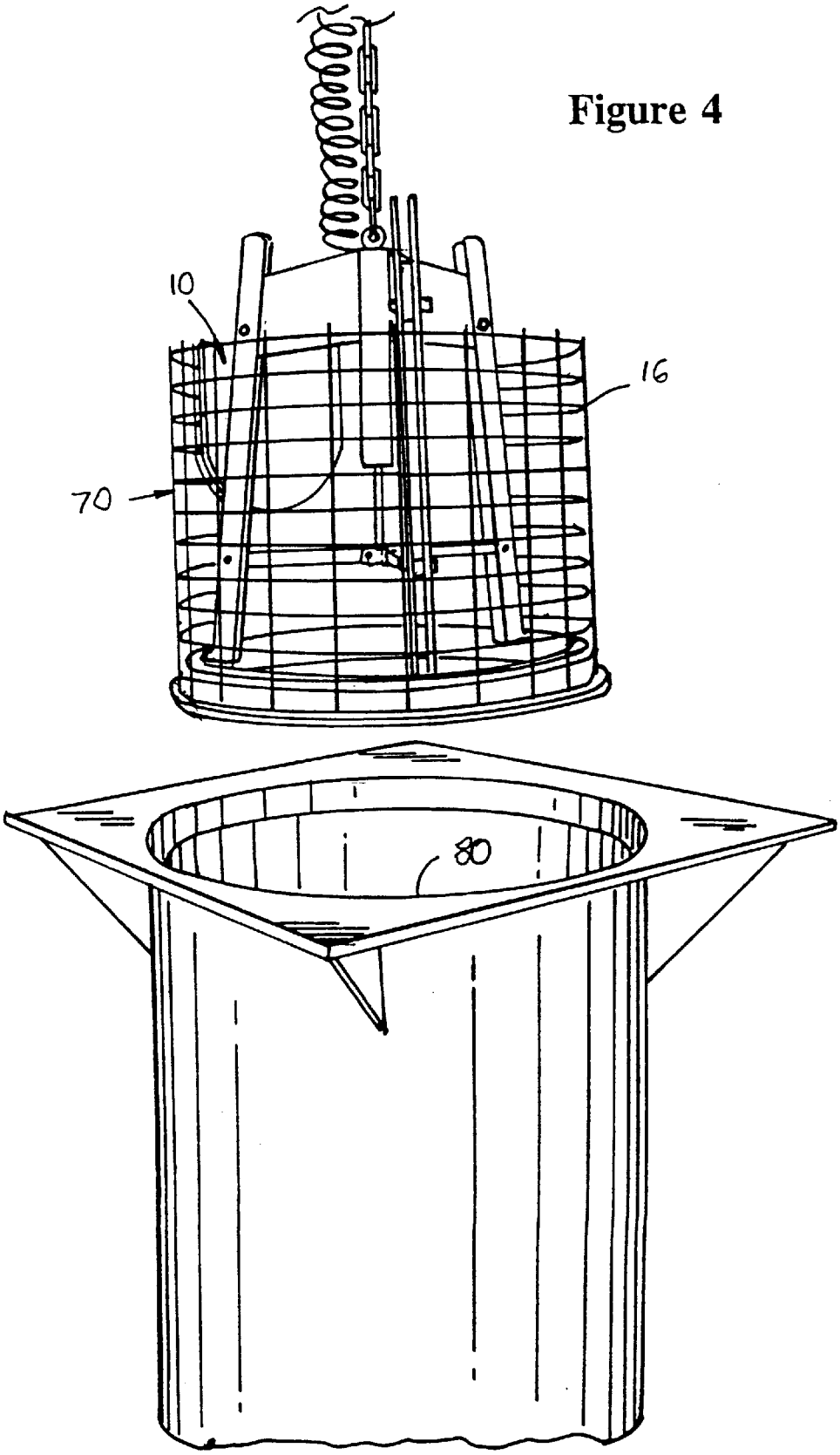
FIG. 4 is a perspective view of the hole former and the reinforcing wire grid being positioned in a wet cast manhole forming machine.
Figure 5:
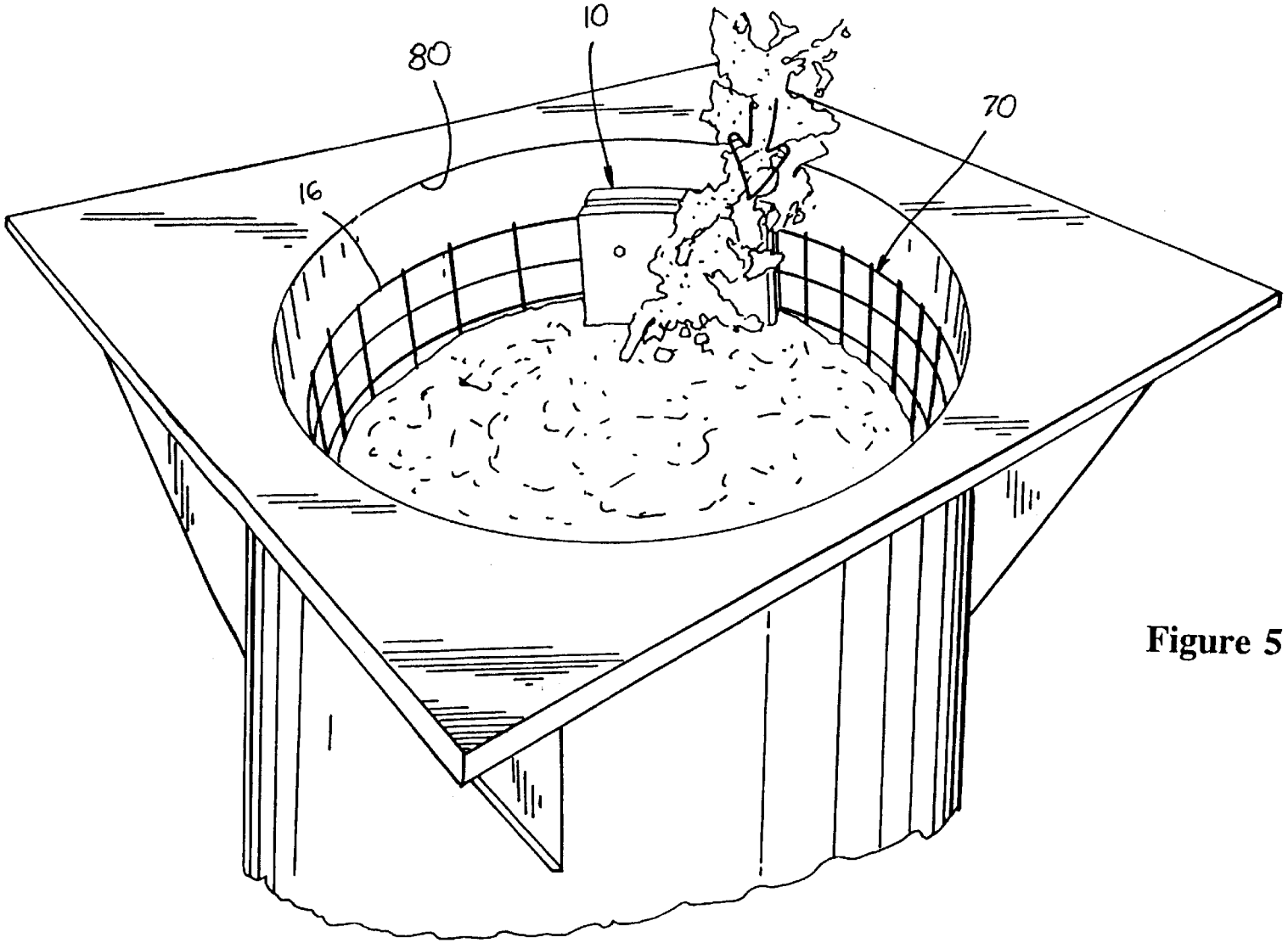
FIG. 5 is a perspective view illustrating the concrete wall of the manhole being formed along with the opening.

The process of attaching the first form portion 20 and the second form portion 22 to the reinforcing wire grid 16 is repeated for any additional openings 14 that are desired to be formed in the concrete object 12. The structure 70 containing both the reinforcing wire grid 16 and the hole former 10 is then placed inside of the outer concrete form 80, as illustrated in FIG. 4. When the structure 70 is inside the outer concrete form 80, the first outer wall 30 is substantially adjacent to the outer concrete form 80.

Concrete is then poured inside of the outer concrete form 80, as illustrated in FIG. 4. A wet cast manhole forming machine (not shown) is placed inside of the outer concrete form 80. A wet cast manhole forming machine for forming the concrete object may be obtained from the Cleco Company of Cleveland, Ohio. The wet cast manhole forming machine propels the concrete towards the outer concrete form 80 where the concrete sticks to the outer concrete form 80. As the process is continued, the wall 18 of the concrete object 12 gradually thickens. Once the wall 18 attains a desired thickness, the wet cast manhole forming machine and any excess concrete are removed from the formed concrete object 12 and the formed concrete object 12 is allowed to cure.

After curing is completed, the cured concrete object 12 is removed from the outer concrete form 80. Next, the bolts 66 are removed from the first and second form portions 20, 22 and the first and second form portions 20, 22 are removed from the cured concrete object 12, as illustrated in FIG. 1, to reveal the concrete object 12 having the opening 14 extending through the wall 18 of the concrete object 12.

The portion of the reinforcing wire grid 16 that extends through the opening 14 is preferably not removed until the concrete object 12 is transported to the location where the concrete object 12 is to be installed. Leaving the reinforcing wire grid 16 intact until it is desired to install the concrete object 12 enhances the strength of the concrete object 12 and thereby makes it less likely that the concrete object 12 will be damaged prior to installation.

Although the present invention has been described with reference to preferred embodiments, workers skilled in the art will recognize that changes may be made in form and detail without departing from the spirit and scope of the invention.

What is claimed is:

1. A method of forming an opening in a concrete structure, the method comprising:

providing reinforcement wire to be used for reinforcing the concrete structure;

attaching a first body and a second body at a selected site on the reinforcement wire, wherein the first and second bodies are configured into the shape of the opening, wherein the first body is positioned on one side of the reinforcement wire, and wherein the second body is positioned on an opposite side of the reinforcement wire across from the first body;

forming the concrete structure about the reinforcement wire; and removing the first and second bodies from the formed concrete structure to expose the opening with the reinforcement wire extending across the opening.

2. The method of claim 1, and further comprising securing the first and second bodies to each other such that the bodies frictionally engage the reinforcement wire therebetween.

3. The method of claim 2, wherein the first and second bodies are secured with respect to the reinforcement wire with a plurality of bolts.

4. The method of claim 1, wherein forming the concrete structure comprises:

placing the reinforcement wire with the first and second bodies attached thereto adjacent to a concrete form;

placing concrete adjacent to the concrete form so that the concrete substantially covers the reinforcement wire and thereby forms the concrete structure; and removing the first and second bodies from the formed concrete structure to expose the opening with the reinforcement wire extending across the opening.

5. The method of claim 1, and further comprising removing the reinforcement wire that extends across the opening.

6. A method of forming a concrete manhole having an opening extending through a wall of the concrete manhole, wherein the concrete manhole comprises a reinforcing wire grid with a shape that generally corresponds with a desired shape of the concrete manhole, the method comprising:

attaching a first form body and second form body to the reinforcing wire grid at a selected location so that a portion of the reinforcing wire grid extends between the first and second form bodies;

forming the concrete manhole about the reinforcing wire grid; and removing the first and second form bodies from the concrete manhole to expose the opening with the reinforcing wire grid extending across the opening.

7. The method of claim 6, and further comprising securing the first and second bodies to each other such that the bodies frictionally engage the reinforcing wire grid therebetween.

8. The method of claim 7, wherein the first and second bodies are secured with respect to the reinforcing wire grid with a plurality of bolts.

9. The method of claim 6, wherein forming the concrete manhole comprises:

placing the reinforcing wire grid with the first and second bodies attached thereto adjacent to a concrete form; and placing concrete adjacent to the concrete form so that the concrete substantially covers the reinforcing wire grid and thereby forms the concrete manhole.

10. The method of claim 9, and further comprising removing the reinforcing wire grid that extends across the opening.

* * * * *